United States Patent [19]

Otani et al.

[11] 4,319,797

[45] Mar. 16, 1982

[54] ELECTRICAL CONNECTOR WITH TERMINAL LOCKING MEANS

[75] Inventors: Shuichi Otani, Tokyo; Shinichi Kato, Fujisawa; Susumu Hashimoto, Kitakawabe; Kyohichi Itoh, Ichinoseki, all of Japan

[73] Assignee: Nissan Motor Company, Limited, Yokohama, Japan

[21] Appl. No.: 130,068

[22] Filed: Mar. 13, 1980

[30] Foreign Application Priority Data

Mar. 20, 1979 [JP] Japan ..... 54-36093[U]

[51] Int. Cl.[3] ..... H01R 13/629

[52] U.S. Cl. ..... 339/75 R; 339/91 R; 339/217 R

[58] Field of Search ..... 339/39, 40, 75 R, 44 R, 339/217 R, 217 S, 91 R

[56] References Cited

U.S. PATENT DOCUMENTS

| | | | |
|---|---|---|---|
| 3,688,243 | 8/1972 | Yamada et al. | 339/91 R X |
| 3,805,211 | 4/1974 | Moore | 339/217 S X |
| 4,174,879 | 11/1979 | Suverison | 339/217 S |

*Primary Examiner*—Eugene F. Desmond

*Attorney, Agent, or Firm*—Schwartz, Jeffery, Schwaab, Mack, Blumenthal & Koch

[57] ABSTRACT

A locking arm having at one end a hook portion is unitedly connected at its generally middle portion to a housing of a female terminal. The locking arm is constructed to be biased to pivot in a given direction about the unitedly connected portion so that upon coupling between the male and female terminals, the hook portion is forced to enter an opening of the male terminal permitting locking connection therebetween.

5 Claims, 6 Drawing Figures

ELECTRICAL CONNECTOR WITH TERMINAL LOCKING MEANS

FIELD OF THE INVENTION

The present invention relates in general to an electrical connector and more particularly to an electrical connector of a type having a locking mechanism by which male and female plugs of the connector are locked to each other for assuring tight connection therebetween.

OBJECTS OF THE INVENTION

It is an object of the present invention to provide an improved electrical connector wherein undesired accidental disconnection of a male terminal from a female terminal and vice versa is assuredly prevented.

It is another object of the present invention to provide an improved electrical connector which has a locking mechanism by which the male and female terminals are locked upon completion of coupling therebetween.

It is still another object of the present invention to provide an improved electrical connector having a locking mechanism for the male and female terminals, in which disconnection of these terminals is easily made by applying a slight manual force to the locking mechanism.

It is a further object of the present invention to provide an improved electrical connection wherein the proper coupling between the male and female plugs can be recognized by a slight shock which is produced upon the proper coupling.

Other objects and advantages of the present invention will become apparent from the following description when taken in conjunction with the accompanying drawings which are outlined hereinafter.

DESCRIPTION OF PRIOR ART ELECTRICAL CONNECTOR

Prior to describing in detail the construction of the electrical connector of the invention, outlined explanation of a conventionally used electrical connector of a type accompanied with a battery terminal connector will be made with reference to FIG. 1 in order to clarify the invention. It should be noted that such type connector is particularly used in a case wherein the current transmittance by a cable (22) leading from the battery terminal connector is not sufficient in normally operating an electrical device because of a certain voltage drop due to the internal resistance of the cable.

Figure 1:
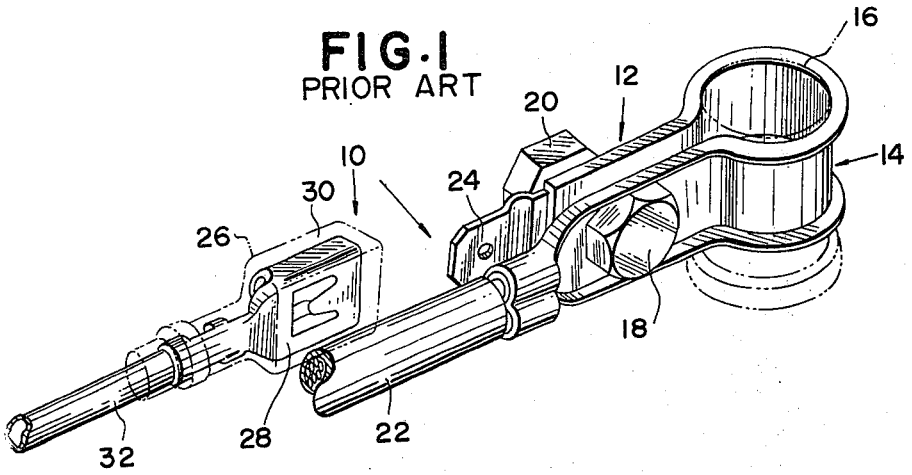
FIG. 1 PRIOR ART
FIG. 1 is a perspective view of a conventional electrical connector, the connector being shown as accompanied with a battery terminal connector.

Referring to FIG. 1 of the drawings, there is shown a conventional electrical connector 10 of a type accompanied with a battery terminal connector 12. The battery terminal connector 12 hereinshown comprises a clamp member 14 which is disposed at its circularly turned section about a terminal pin 16 of a battery (not shown). A bolt 18 passes through holes (no numeral) formed in leg portions of the clamp 14 and is tightened by a nut 20 to cause the clamp 14 to tightly clamp the pin 16. Designated by numeral 22 is the cable or wire 22 which extends from one of the leg portions of the clamp 14 to high power consumption electrical devices, such as a starter motor (not shown).

The electrical connector 10 shown as accompanied with the battery terminal connector 12 comprises a male plug or terminal 24 which is fixed to one of the leg portions of the clamp 14 by means of the bolt 18 and the nut 20. As shown, the male terminal 24 is formed like a tongue. A female plug 26 comprises a female terminal 28 and an insulating housing 30 in which the female terminal 28 is housed. The insulating housing 30 is formed at its right side in FIG. 1 with an opening into which the male terminal is inserted when coupling of the male and female terminals 24 and 28 is required for electrical connection therebetween. Designated by numeral 32 is a cable which connects the female terminal 28 with another electrical device (not shown).

Hitherto, however, the above-mentioned type connector 10 lacks a so-called locking means which assures a locking connection between the male and female terminals 24 and 28. Thus, it often happens that the female terminal 28 is accidentally disconnected from the fixed male terminal 24 when the cable 32 is inadvertently pulled away with only a small force.

It is accordingly an essential object of the present invention to provide an electrical connector which is free of the above-mentioned problem.

DESCRIPTION OF THE EMBODIMENT

Figure 2:
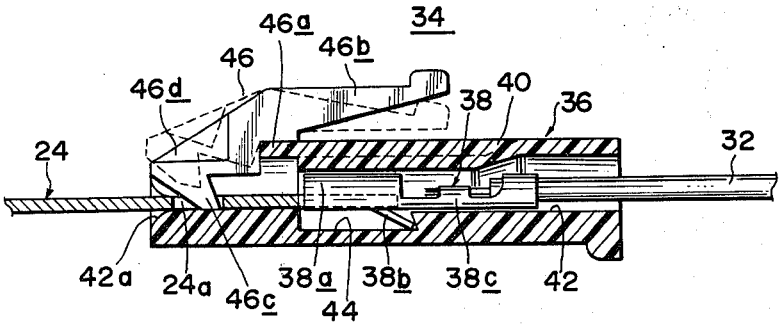
FIG. 2 is a sectional view of an improved electrical connector embodying the invention, depicting a procedure for disconnecting a female plug from a male plug.
Figure 3:
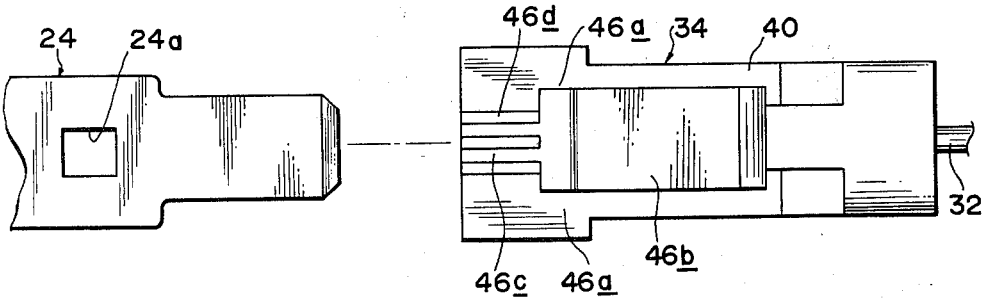
FIG. 3 is a plan view of the electrical connector of FIG. 2 with the male and female plugs being separated.

Referring to FIGS. 2 and 3, particularly FIG. 2, there is illustrated a first preferred embodiment of the present invention. The electrical connector 34 shown in FIG. 2 assumes a coupling condition wherein the male and female terminals are coupled with each other. The connector 34 of this embodiment comprises a tongue-shaped male plug or terminal 24 which is constructed of an electrically conductive material. Although not shown, the male terminal 24 is fixed to a battery terminal connector in substantially the same manner as in the case of FIG. 1. As shown in FIG. 3, the male terminal 24 is formed with a rectangular opening **24*a* for the reason which will be described hereinafter. The leading end section of the male terminal 24 is somewhat reduced in width for facilitating insertion of the male terminal 24 into a female plug 36** which will be explained hereinnext.

The female plug 36 comprises a female terminal 38 which is housed in an insulating housing 40 of a plastic. The female terminal 38 is formed at its mating section **38*a* with a lug 38*b* which is inclined backwardly as shown, so that when the female terminal 38 is properly received in the housing 40, the lug 38*b* engages at its free end with a right-positioned wall of a recess 44 which is merged with a passage 42 of the housing 40. With this, rightward displacement of the female terminal 38 relative to the housing 40 is prevented. The female terminal 38 is formed with a gripping section 38***c* by which an end of the cable 32 is gripped. As will become clear as the description proceeds, the male terminal 24 is inserted into the passage 42 from the left entrance 42*a* of the same and is locked in a place, engaging the mating section of the male terminal 24 with the mating section 38*a* of the female terminal 38, as is shown in FIG. 2

According to the present invention, next-mentioned locking mechanism is provided to the connector 34. As is best shown in FIG. 2, a seesaw like locking arm 46 is formed on the housing 40 at a position near the left opening 42*a* to assure locking connection between the male and female terminals 24 and 38. The locking arm 46 and the housing 40 are molded as a one piece article. The locking arm 46 is united at its generally middle section with the housing 40 so that it can be pivotable about the united portion 46*a* upon application of a certain degree of force to the locking arm 46. The right section of the locking arm 46 with respect to the united portion 46*a* constitutes a handle 46*b* which is used for manually operating the locking arm 46. As shown, the handle 46*b* is shaped to have a generally triangular cross section to be permitted to pivot in a clockwise direction, in FIG. 2, about the united portion 46*a*. Further, the locking arm 46 is formed at its left end with a hook portion 46 *c* which is reinforced by several ribs 46*d*. It should be now noted that the locking arm 46 is formed to be biased to pivot in a counterclockwise direction in FIG. 2 about the united portion 46*a*.

Accordingly, for coupling between the male and female terminals or plugs 24 and 38, when the male terminal 24 is inserted into the housing 40 from the left opening 42*a* and is moved axially to the right, the hook portion 46*c* of the locking arm 46 is depressed in an upward direction by the leading end section or mating section of the male terminal 24. As the male terminal 24 continues to be moved to the right and finally the mating section of the male terminal 24 is tightly received in the mating section of the female terminal 38, the opening 24*a* of the male terminal 24 is finally disposed directly over the hook portion 46*c*, allowing the hook portion 46*c* to return toward its original generally undepressed position. Thus, the hook portion 46*c* enters the opening 24*a* of the male terminal 24 and the terminal 24 is now locked in place. Thus, further axial movement of the male terminal 24 to the right or the left is prevented.

When disconnection of the male terminal 24 from the female terminal 38 is required, the handle 46*b* of the locking arm 46 is depressed downward to cause the hook portion 46*c* to be lifted and disengaged from the opening 24*a*. With the hook portion 46*c* lifted, the male terminal 24 is axially withdrawn from the housing 40 of the female plug 36, disengaging from the female terminal 38.

Figure 4:
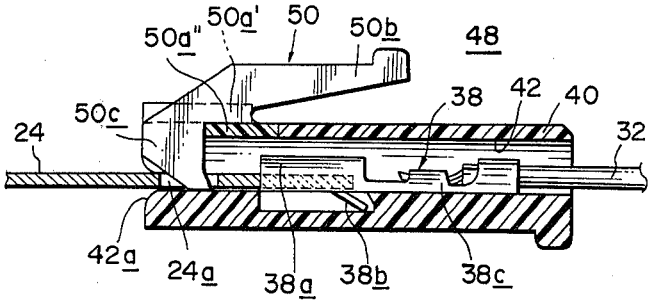
FIG. 4 is a sectional view of another improved electrical connector of the invention.
Figure 5:
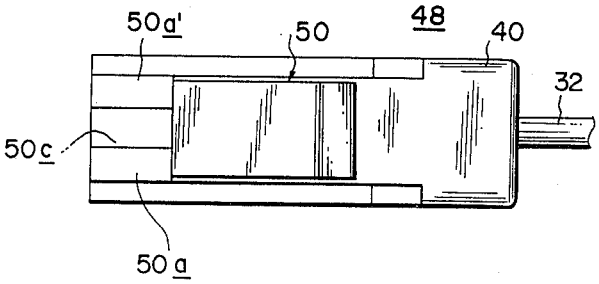
FIG. 5 is a plan view of the another improved electrical connector with the male and female plugs being coupled.
Figure 6:
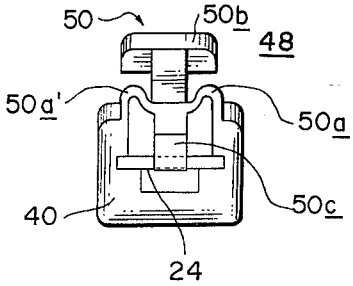
FIG. 6 is a side view of the electrical connector of FIG. 4.

Referring to FIGS. 4 to 6, there is illustrated a second preferred embodiment of the invention. The electrical connector 48 of this embodiment is similar in construction to the above-mentioned first embodiment, and comprises substantially the same parts or elements as those in the first embodiment except for the locking mechanism. For facilitation of description, explanation of such same parts will be omitted from the following, but such parts are designated by the same numerals in the drawing.

The locking mechanism according to the second embodiment comprises a seasaw like locking arm 50. Similarly to the first embodiment, the locking arm 50 is formed on the housing 40 near the left opening 42*a*, and the locking arm 50 and the housing 40 are molded as a one piece article. The locking arm 50 has a handle 50*b* and a hook portion 50*c* both of which have generally the same functions as in the case of the first embodiment. As will be understood from FIGS. 4 and 6, the locking arm 50 is united to the housing 40 by a pair of bridge sections 50*a* and 50*a'* each extending from the generally middle section of the locking arm 50 to the front end of the hook portion 50*c* (that is the leftmost end of the locking arm 50 as viewed in FIG. 4). Preferably, each of the bridge sections 50*a* and 50*a'* is constructed to have a semicircular cross section to cause the locking arm 50 to have a large pivoting range. Also in this embodiment, the locking arm 50 is constructed to be biased in a counterclockwise direction for the same reason which has been mentioned in the item of the first embodiment. If desired, in addition to the bridge sections 50*a* and 50*a'*, the locking arm 50 may be provided with another pivotting section 50*a''* in substantially the same manner as the united portion 46*a* of the locking arm 46 of the first embodiment.

From the above, it will be appreciated that, according to the present invention, the undesired accidental disengagement of the male and female terminals or plugs is assuredly prevented, while, disconnection of them is easily made by pulling the female plug away from the male plug with the handle of the locking arm being pressed.

Further, it will be appreciated that the proper coupling between the male and female plugs can be recognized by a slight shock which will be produced when the hook portion enters the opening of the male terminal.

What is claimed is:

1. An electrical connector comprising:

an insulating housing having therein a through passage;

a female terminal received and locked in said passage of said housing, said female terminal having a female mating section;

a male terminal having a male mating section, said male mating section being engageable with said female mating section of said female terminal to achieve electrical connection therebetween upon insertion of said male terminal into said housing; and locking means for providing locking connection between said male and female terminals upon engagement of said male and female mating sections, wherein said locking means comprises:

an opening formed in said male mating section of said male terminal; and a locking arm united at its generally middle section with the outer surface of said housing and having a hook portion at one longitudinal end and a handle portion which extends outwardly from the generally middle section in a direction opposite to said hook portion, said locking arm being biased to pivot in a given direction whereby upon insertion of said male terminal into said housing, said hook portion is forced to engage with said opening of said male terminal thereby completing the locking connection between said male and female terminals.

2. An electrical connector as claimed in claim 1, further comprising a second locking means which achieves locking of said female terminal relative to said housing, said second locking means including a recess formed in said housing to be merged with said through passage, and a lug extending from said female terminal, the free end of said lug being in engagement with a side wall of said recess to inhibit movement of said female terminal in a given direction.

3. An electrical connector as claimed in claim 2, in which said handle portion is constructed to have a generally triangular cross section.

4. An electrical connector as claimed in claim 3, in which said hook portion is reinforced by ribs which are unitedly formed on said locking arm.

5. An electrical connector comprising:

an insulating housing having therein a through passage and at least a male terminal entrance;

a female terminal received and locked in said passage of said housing, said female terminal having a female mating section;

a male terminal having a male mating section including an aperture therethrough, said male mating section being engageable wth said female mating section of said female terminal to achieve an electrical connection therebetween upon insertion of said male terminal into said housing via said male terminal entrance;

a movable locking arm pivotally attached at a midpoint thereof to the outer surface of said housing, said arm including an inwardly projectng locking hook formed on one end of said arm adjacent said male terminal entrance, said arm being biased to pivot said locking hook into engagement with the male mating section aperture upon insertion of said male terminal into said housing thereby providing a locking connection between said female and male terminals; and means formed on the opposite end of said arm for pivoting the locking hook out of engagement with said aperture in response to the manual depression of said means to release said male terminal.

* * * * *